US006056273A

United States Patent [19]

Smith

[11] Patent Number: 6,056,273

[45] Date of Patent: May 2, 2000

[54] INTERNAL SHEAVE PULLEY SYSTEM FOR BIPODS, TRIPODS, OR QUADRIPODS

[76] Inventor: Daniel I. Smith, P.O. Box 36, Petaluma, Calif. 94953

[21] Appl. No.: 09/200,123

[22] Filed: Nov. 25, 1998

Related U.S. Application Data

[60] Provisional application No. 60/066,682, Nov. 25, 1997.

[51] Int. Cl.[7] ..... B66D 1/00

[52] U.S. Cl. ..... 254/266; 254/335; 254/390; 254/394; 248/163.1

[58] Field of Search ..... 254/264, 266, 254/283, 284, 288, 335, 338, 380, 390, 394, 413; 248/163.1, 364, 121

[56] References Cited

U.S. PATENT DOCUMENTS

| | | | |
|---|---|---|---|
| 491,168 | 2/1893 | Griffith | 254/337 |
| 1,215,874 | 2/1917 | Scherrer | 254/338 |
| 1,924,317 | 8/1933 | How et al. | 254/266 X |
| 2,351,824 | 6/1944 | Tourneau | 254/337 X |
| 3,100,625 | 8/1963 | Back | 254/335 |
| 3,503,390 | 3/1970 | Peters | 254/413 X |
| 5,284,324 | 2/1994 | Bunger | 254/266 |

FOREIGN PATENT DOCUMENTS

| | | | |
|---|---|---|---|
| 283071 | 1/1928 | United Kingdom | 254/337 |

*Primary Examiner*—Donald P. Walsh
*Assistant Examiner*—Emmanuel M. Marcelo
*Attorney, Agent, or Firm*—Larry D. Johnson

[57] ABSTRACT

A bi-, tri-, or quadripod apparatus utilized over a confined space to aid in the introduction or removal of persons or equipment into the space, including a head casting with upright members extending vertically downwards and outwardly from the head casting. An anchor plate is centered and affixed in each of the respective exterior surfaces of the head casting, and the anchor plates have apertures in or about their lower portions for the attachment of support and/or hauling devices. Installation of a pulley sheave in each of both ends of one of the upright members improves bi-, tri-, and quadripod performance and makes it possible to provide an additional anchor or lift point in the proximal pulley; to eliminate the need to attach extra pulleys at attachment points for operation of a leg (upright member) mounted winch; to provide increased mechanical advantage of up to 2:1 with the addition of one additional pulley; to provide a distal end pulley, which allows remote pulling forces to be directed at the stable bottom of the apparatus rather than the less stable top; and to produce compressive forces on the leg structure during use, rather than lateral loading, thus increasing the load bearing capacity of the apparatus.

9 Claims, 4 Drawing Sheets

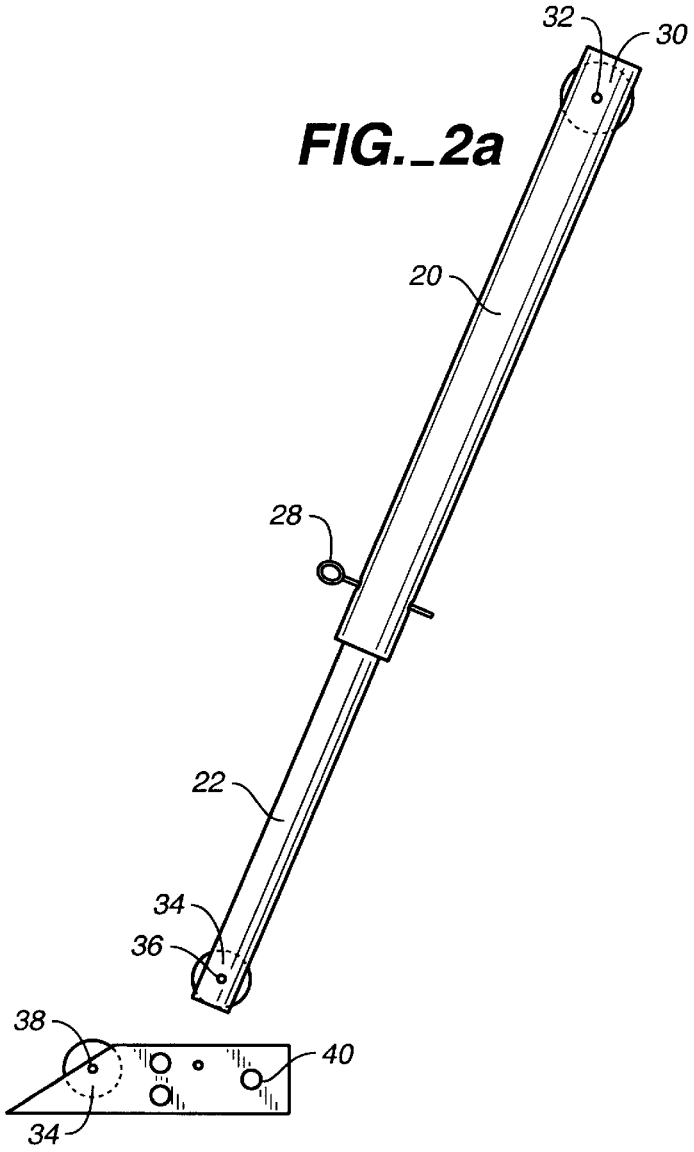
FIG._2a
FIG._2b
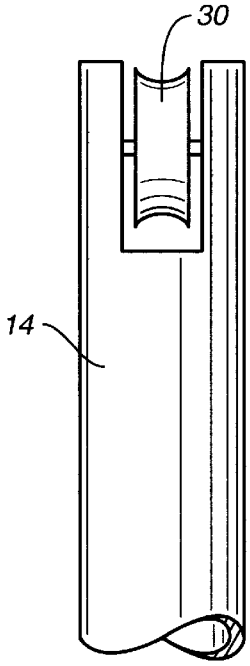
FIG._2c

INTERNAL SHEAVE PULLEY SYSTEM FOR BIPODS, TRIPODS, OR QUADRIPODS

This application claims the priority of Provisional Patent Application Ser. No. 60/066,682, filed Nov. 25, 1997.

BACKGROUND OF THE INVENTION

1. Field of the Invention

The present invention relates to bipods, tripods, or quadripods, and more specifically to portable bi-, tri-, and quadripods of the type used to aid in vertically inserting and extracting personnel and equipment into confined spaces, including, among others: manholes; mines; oil, water, and gas wells; crevices and fissures; and the like. This kind of device is typically employed in confined space extrication, crash rescue operations, industrial safety, mining, oil/gas refining, building collapse, marine operations, fire rescue operations, and civil defense operations.

2. Background of the Prior Art

Prior art bi-, tri-, and quadripods typically consist of a support member and two, three, or four legs, respectively, pivotally attached to the support member and extending downward and outwardly from the respective corners of the support member to form a base. The support member usually includes attachment points for such devices as pulleys, manual or motorized winches, or other kinds of block-and-tackle with mechanical advantages for hauling and supporting objects with either cable or rope. During the use of such an apparatus, generally no more than one attachment point may be used at any one time in bipods, three attachment points in tripods, and four attachment points in quadripods, thus limiting the number and arrangement of devices deployable and loads manipulable. Further, devices and loads attached to the support member induce forces acting on the legs which are both compressive and lateral and do not optimize the load bearing capacity of the legs.

It would thus be desirable to provide an improved bi-, tri-, or quadripod apparatus which is able to accommodate an increased number of devices while also providing for increased stability and load tolerance. It would be further desirable to provide an apparatus that makes it possible to haul from a remote location so as to minimize congestion in the immediate area of the apparatus, and to do so without causing increased lateral instability in the apparatus.

None of the known prior art, either singly or in combination, is seen to disclose the specific arrangement of concepts disclosed by the present invention.

SUMMARY OF THE INVENTION

The present invention provides a means for achieving the objectives outlined above. According to the present invention, a bi-, tri-, or quadripod utilized over a confined space to aid in the introduction or removal of persons or equipment into the space includes a head casting with legs extending vertically downwards and outwardly from the head casting. An anchor plate may be centered and affixed in one or all of the respective exterior surfaces of the head casting, and the anchor plates have apertures in or about their lower portions for the attachment of support and hauling devices. The principal characteristic of the present invention which makes it possible to achieve the above-indicated objectives is the installation of a pulley sheave in each of both ends of one of the legs.

The pulley system of the present invention improves bi-, tri- and quadripod performance and makes it possible to achieve the following objectives:

(1) to provide an additional anchor or lift point in the proximal pulley;

(2) to eliminate the need to attach extra pulleys at attachment points for operation of a leg (upright member) mounted winch;

(3) to provide increased mechanical advantage of up to 2:1 with the addition of one additional pulley;

(4) to provide a distal end pulley which allows remote pulling forces to be directed at the stable bottom of the apparatus rather than the less stable top; and (5) to provide compressive forces on the leg structure, rather than lateral loading, and this increases the load bearing capacity of the apparatus while doing work.

With these and other objects in view which will more readily appear as the nature of the invention is better understood, the invention consists in the novel combination and arrangement of parts hereinafter more fully described, illustrated and claimed, with reference being made to the attached drawings.

BRIEF DESCRIPTION OF THE DRAWINGS

Preferred forms of the present invention will now be described by way of example with reference to the accompanying drawings, wherein;

FIG. 2*a* is a side elevation view of an elongated leg tube showing proximal and distal leg-mounted internal sheave pulleys, and further showing an optional installation scheme for said distal internal sheave pulley.

FIG. 2*b* is a side elevation view showing a base foot member that may optionally be pivotally affixed to the leg tube shown in FIG. 2*a;*

FIG. 2*c* is a side elevation view showing details of the proximal segment of the upper tube section of FIG. 2*a* rotated 90 degrees, and particularly showing the proximal internal sheave pulley;

DETAILED DESCRIPTION OF A PREFERRED EMBODIMENT

Figure 1A:
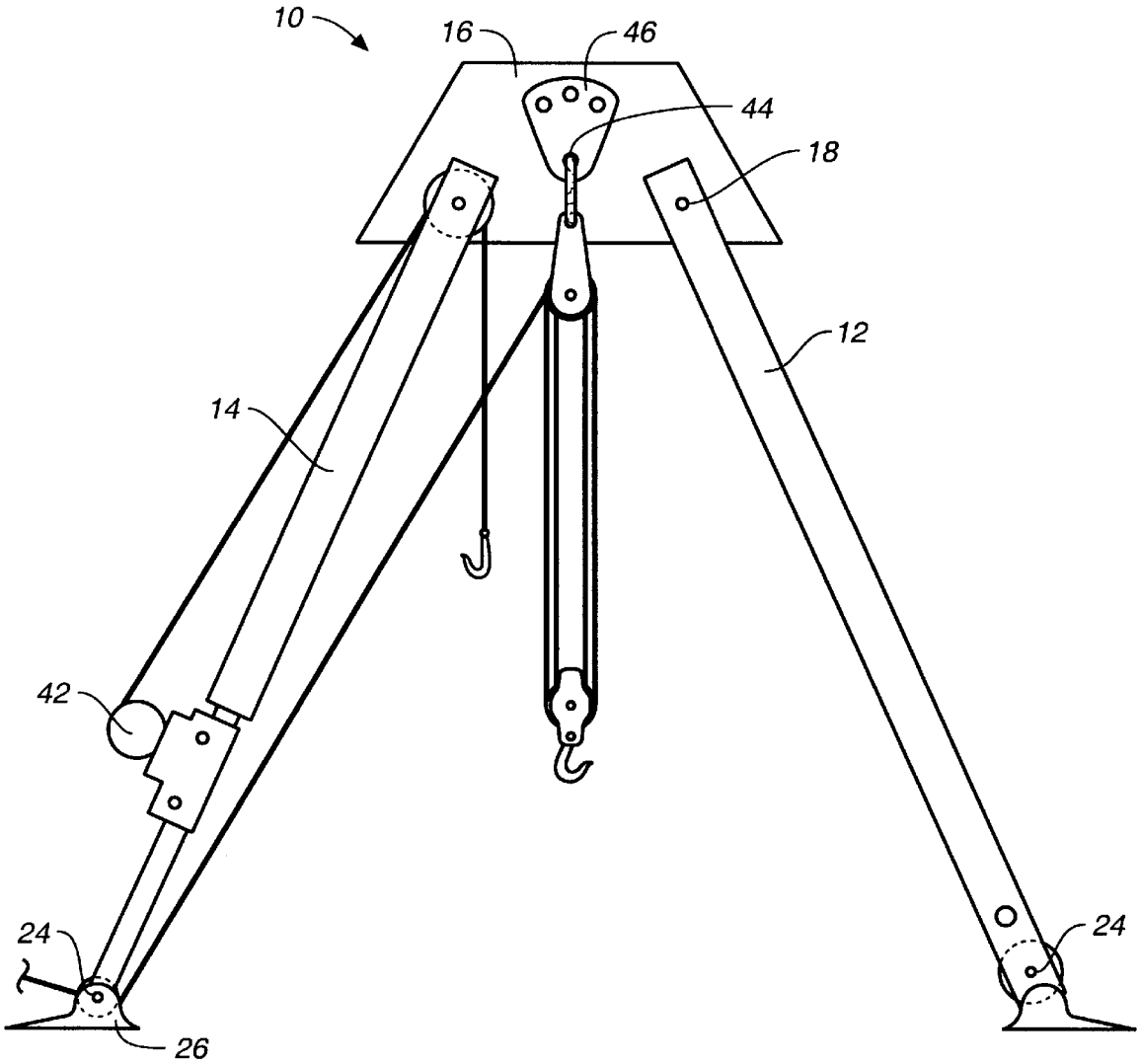
FIG. 1*a* is a side elevation of the apparatus of the present invention, wherein a pulley attached to an anchor plate is shown and two legs are shown.

Referring to FIGS. 1*a* through 2*c*, the apparatus 10 of the present invention, includes first and second legs 12 and 14, and a head casting 16 having an affixed anchor plate 44 with an attachment or attachments for a pulley or pulleys or other devices for supporting or hauling a load.

The proximal ends of each of the legs are slidably received in a respective coupling in the support member 16 and are pivotally secured in place by a retention pin 18 received through a hole in the leg and support member 16.

The legs comprise two tube sections each 20 and 22. The proximal end of the first tube section 20 pivotally connects to the support member 16 via a retention pin 18. The second tube section 22 is telescopically received in the other end of the first tube section 20 with the distal end of the second tube section being pivotally and detachably connected with a retention pin 24 to a base foot 26. The first and second tube sections are secured together by a retention pin 28 and cotter pin. In this manner, the length of the legs 12 and 14 may be selectively adjusted. In the assembled, upright, and deployed condition, the apparatus has either a triangular, trigonal pyramidal, or tetrahedral shape, in the case of bi-, tri-, and quadripods, respectively. The base line of a bipod is linear, that of a tripod is triangular, and that of a quadripod is generally square, though certainly quadrilateral.

Figure 1B:
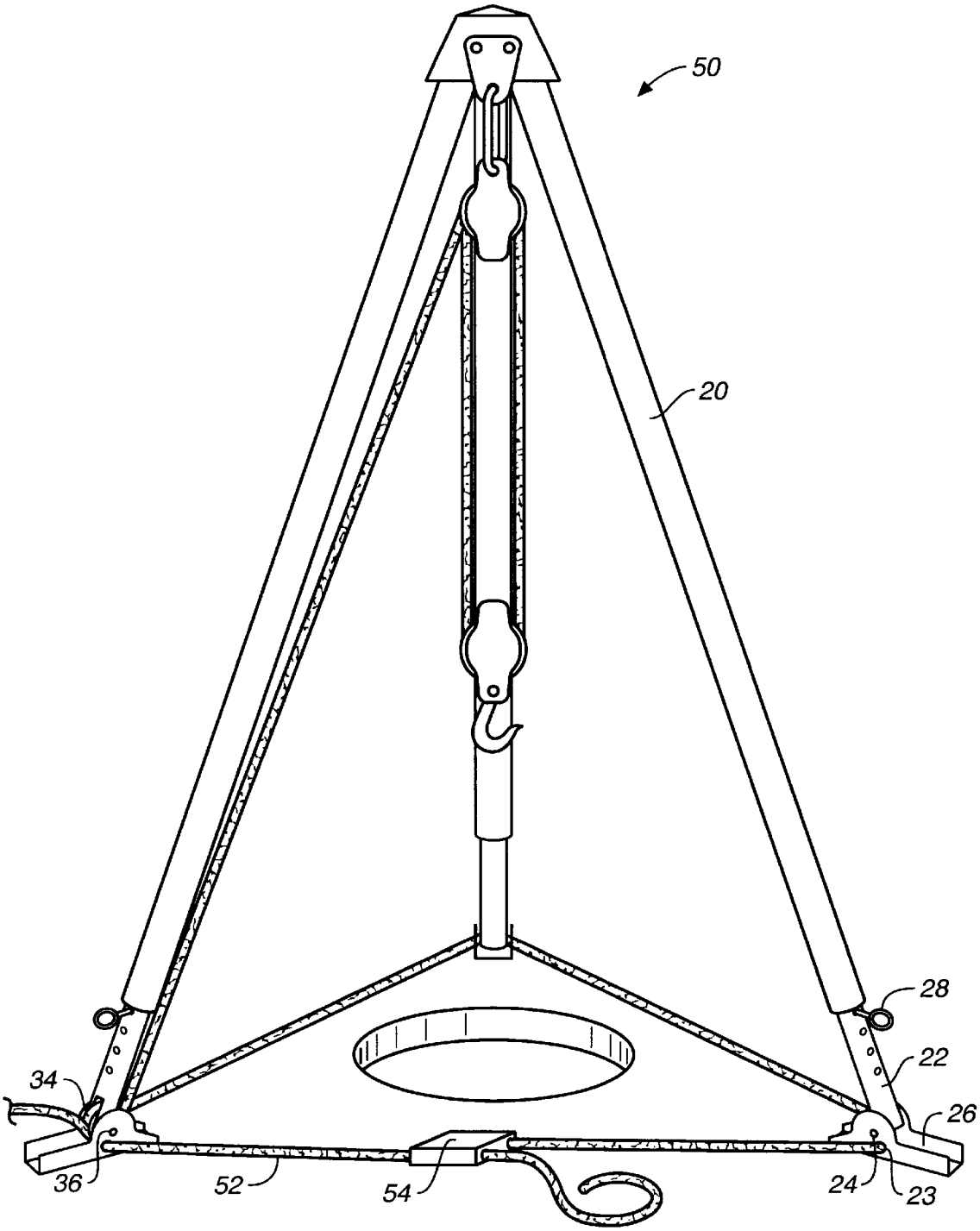
FIG. 1*b* is a schematic perspective view of a second preferred embodiment of the present invention, namely, a tripod comprising three legs.
Figure 1C:
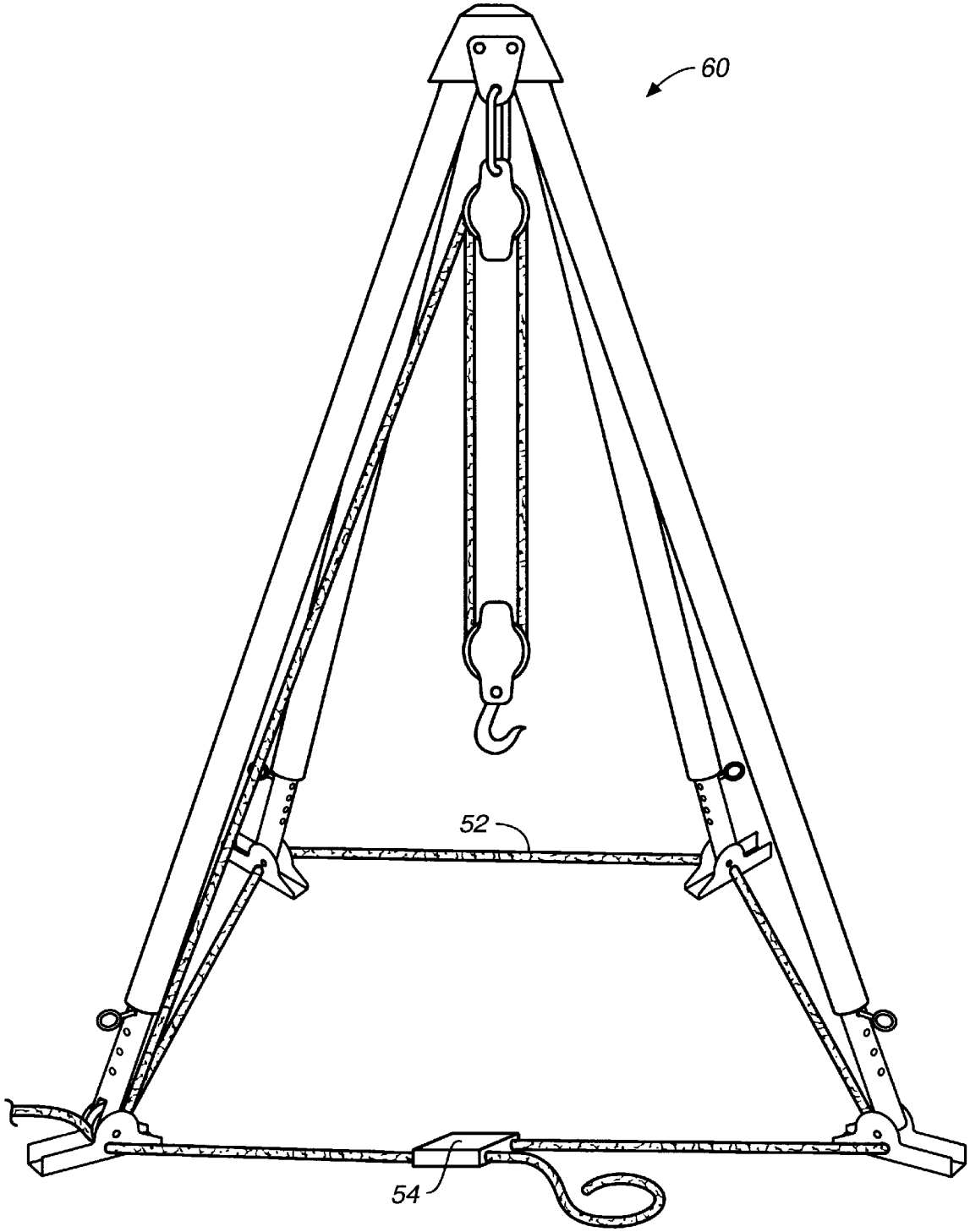
FIG. 1*c* is a schematic perspective view of a third preferred embodiment of the present invention, namely, a quadripod comprising four legs.

FIGS. 1*b* and 1*c* show the second and third preferred embodiments of the present invention, a tripod 50 and quadripod 60, respectively. The base line and the structural integrity of the base support of each embodiment is preferably enhanced by threading a continuous length of rope 52 through apertures 23 (FIG. 1*a*) in the distal ends of the legs. The apertures may also extend through foot pads pivotally connected to the distal end of each leg (FIGS. 1*b* and 1*c*), in which case the rigging is threaded through the foot pads as well. The length of the rope is preferably controlled by threading the rope through a rope clamp 54.

The second leg 14 is formed in two sections, as described above, so as to be selectively adjustable in length. In addition, an internal sheave pulley 30 is incorporated and connected with a retention pin axle 32 in an aperture at the proximal end of the first tube section, such that the pulley rotates about an axis perpendicular to the longitudinal axis of the leg.

An internal sheave pulley 34 is also incorporated and connected with a retention pin axle 36 at the distal end of the second tube section of the second upright member 14, such that it rotates about an axis perpendicular to the longitudinal axis of the leg. Each pulley is of a diameter slightly larger than that of the tube section to which it is connected.

Optionally, the distal pulley may be incorporated and connected via a retention pin 38 in the exterior section of a base foot 40 such that it rotates about an axis perpendicular to the longitudinal axis of the leg.

A mechanical winch 42 may be attached to the second (distal) tube of the second leg.

In use, the support member is positioned above a confined space and the base is secured and configured on a surface (ground or otherwise) about or around the opening to the confined space. A pulley system (as shown in FIG. 1) may be suspended from an attachment point 44 formed in an anchor plate 46 affixed to the support member 16. This pulley system may be used to raise or lower persons or equipment from confined spaces.

The various components of the apparatus 10 can be disassembled by detaching the components from one another so that the apparatus 10 can be stored and transported in compact form. When the components are disconnected from one another, the retention pins and cotter pins are connected to the tubes forming the legs by a ring affixed to the tubes near the connection points.

Typical instructions for use that might accompany the inventive product in tripod form follow:

1. Remove the tripod from the carry case and place on the ground near the point of intended use. Inspect the tripod for any signs of damage to the tube legs. Do not use the tripod if there appears to be any damage such as obvious dents or if the tubes appear to be out of round, or if there appears any heat damage or deep cuts to the tubes.

2. To set up the tripod, you must loosen the rope around the base of the tripod (assuming the rope is already connected to the base of the tripod). To do this, you must hold open the safety catch on the rope clamp and pull the rope through almost completely to the end of the rope. This will ensure that there is enough slack in the rope to set up the tripod.

3. After loosening the rope at the base of the tripod, spread each leg of the tripod out to the recommended base width (6' at 10', 9' at 12'), then move each leg approximately 2 inches inward to ensure there is no outward pressure on the head of the tripod. Tighten the rope in the rope claim by pulling the tail end of the rope back through the rope clamp—this removes the slack in the rope. You are now ready to load the tripod. On expanded metal decks you may use "T" or "J" bolts to secure the tripod's base further.

4. After adjusting the legs of the tripod, connect the hauling equipment. Ensure that the hauling equipment is in working order. DO NOT EXTEND PAST RED SAFETY MARKERS ON LEG SECTIONS AT ANY TIME (on 12' tripods this is the 6th hole on the lower section and the 8th hole on the second section).

5. When hauling equipment is connected and you are satisfied that it is in working order, extend the legs on the tripod to the desired height by first pulling out the safety lock ("R" grip clips) and the linchpins which hold the legs in place. Lift each leg to the desired height and reconnect the linchpins. Be sure to reinsert "R" grip clips to prevent accidental release of leg extensions. Adjust all legs so the tripod head is level or parallel to load being hauled. If possible, guidelines will increase stability and safety. Remember to maintain each leg's position off the head, as described in #3 above.

6. Once the desired height is obtained and the legs are locked in place, tighten the rope at the base of the tripod by pulling the loose end of the rope through the rope clamp as hard as possible, taking up the slack in the rope. The rope clamp has an automatic locking mechanism which locks the rope into place, during and after adjustment of rope. Remember the legs may open if the slack in the rope is not tightened and held in position by the rope clamp.

7. When dismantling the tripod the rope may be wrapped around the closed legs of the tripod and the loose end of the rope may be threaded through the rope clamp to lock it into position preventing the legs from opening.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed as invention is:

1. A tripod apparatus, comprising:

a generally horizontally disposed head casting;

first, second, and third legs pivotally connected to said head casting and extending downwardly and outwardly therefrom, said first, second, and third legs having selectively adjustable lengths so that in use said head casting can be caused to be generally level despite irregularities of the surface upon which said apparatus base is supported;

first, second, and third support members affixed to said head casting;

an internal sheave pulley incorporated into an aperture and connected with a retention pin axle to the proximal end of said third leg; and an internal sheave pulley incorporated into an aperture and connected with a retention pin axle to the distal end of said third leg.

2. The tripod apparatus of claim 1 wherein said first, second, and third legs each have a generally horizontal foot pad pivotally and detachably connected to the distal end of the said first, second, and third leg; and wherein said first, second, and third legs are selectively detachable from said head casting; and further wherein a continuous and adjustable length of rope is threaded through apertures at the distal end of each of said first, second, and third legs so as to provide stability to the base of said apparatus.

3. The apparatus of claim 2 further including a rope clamp, wherein the ends of said rope are threaded through said rope clamp and the length and tension of said rope controlled thereby.

4. A bipod apparatus, comprising:

a generally horizontally disposed head casting;

first and second legs spaced generally equally from the center of said head casting, pivotally connected to said head casting, and extending downwardly and outwardly therefrom, said first and second legs having selectively adjustable lengths so that in use said head casting can be caused to be generally level despite irregularities of the surface upon which said apparatus base is supported;

a support member affixed to one vertical side of said head casting;

an internal sheave pulley incorporated into an aperture and connected with a retention pin axle to the proximal end of said second leg; and an internal sheave pulley incorporated into an aperture and connected with a retention pin axle to the distal end of said second leg.

5. The bipod apparatus of claim 4 wherein said first and second legs each have a generally horizontal foot pad pivotally and detachably connected to the distal end of said first and second leg; and wherein said first and second legs are selectively detachable from said head casting; and wherein a continuous and adjustable length of rope is threaded through apertures at the distal end of each of said first, second, and third legs.

6. The bipod apparatus of claim 5 further including a rope clamp, wherein the ends of said rope are threaded through said rope clamp and the length and tension of said rope controlled thereby.

7. A quadripod apparatus, comprising:

a generally horizontally disposed head casting;

first, second, third, and fourth legs pivotally connected to said head casting, and extending downwardly and outwardly therefrom, said first, second, third, and fourth support members affixed to the exterior perimeter of said head casting; said first, second, third, and fourth legs having selectively adjustable lengths so that in use said head casting can be caused to be generally level despite irregularities of the surface upon which said apparatus is supported;

an internal sheave pulley incorporated into an aperture and connected with a retention pin axle to the proximal end of said fourth leg; and an internal sheave pulley incorporated into an aperture and connected with a retention pin axle to the distal end of said fourth leg.

8. The quadripod apparatus of claim 7, further comprising:

a first, second, third, and fourth generally horizontal foot pad pivotally and detachably connected to the distal ends of said first, second, third, and fourth legs, respectively; said first, second, third, and fourth legs being selectively detachable from said head casting; said first, second, third, and fourth legs having apertures at their respective distal ends; and a continuous and adjustable length of rope threaded through said apertures at the distal ends of each of said first, second, third, and fourth legs.

9. The apparatus of claim 8 further including a rope clamp wherein the ends of said rope are threaded through said rope clamp and the length and tension of said rope controlled thereby.

* * * * *